US008499709B2

(12) United States Patent
Lee et al.

(10) Patent No.: US 8,499,709 B2
(45) Date of Patent: Aug. 6, 2013

(54) MOORING SYSTEM FOR A VESSEL

(75) Inventors: Phill-Seung Lee, Daejeon (KR); SoonHung Han, Daejeon (KR); Hyun Chung, Daejeon (KR); Yong-Yook Kim, Daejeon (KR); Kook-Jin Choi, Daejeon (KR); Sang-Il Kim, Daejeon (KR); Young-Hee Cho, Daejeon (KR); Young-Su Kim, Daejeon (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 315 days.

(21) Appl. No.: 12/969,994

(22) Filed: Dec. 16, 2010

(65) Prior Publication Data

US 2012/0114422 A1 May 10, 2012

(30) Foreign Application Priority Data

Nov. 4, 2010 (KR) ..... 10-2010-0109349

(51) Int. Cl.
*E02B 3/24* (2006.01)

(52) U.S. Cl.
USPC ..... 114/230.19

(58) Field of Classification Search
USPC ..... 114/230.1, 230.15, 230.17, 230.18, 114/230.19
See application file for complete search history.

(56) References Cited

U.S. PATENT DOCUMENTS

| | | | | |
|---|---|---|---|---|
| 6,715,977 | B2 * | 4/2004 | Dobner et al. | 414/141.3 |
| 6,910,435 | B2 * | 6/2005 | Hadcroft et al. | 114/230.15 |
| 6,938,570 | B2 * | 9/2005 | Montgomery et al. | 114/230.1 |
| 7,293,519 | B2 * | 11/2007 | Montgomery et al. | 114/230.1 |
| 8,215,256 | B2 * | 7/2012 | Montgomery et al. | 114/230.1 |

FOREIGN PATENT DOCUMENTS

| | | |
|---|---|---|
| JP | S50-068166 | 6/1975 |
| JP | H07-010074 | 1/1995 |
| JP | H07-033075 | 2/1995 |
| JP | 2006-232046 | 9/2006 |
| JP | 2008-195114 | 8/2008 |
| KR | 10-2006-0009809 | 2/2006 |

OTHER PUBLICATIONS

The International Search Report dated Dec. 20, 2011 and Written Opinion.

* cited by examiner

*Primary Examiner* — Daniel Venne
(74) *Attorney, Agent, or Firm* — Bacon & Thomas, PLLC

(57) ABSTRACT

A mooring system for a vessel includes an attachment unit configured to be detachably attached to a hull of the vessel; a robot arm including a plurality of arms, the arms being coupled to each other to turn in a vertical direction, the robot, arm extending by an arm actuator provided thereto to transfer the attachment unit to an attachment position of the hull; a rotation unit connected to the robot arm and allowing the robot arm to turn in a horizontal direction; and a mooring winch for winding a mooring cable to draw the attachment unit. A floating body or a quay wall may include the mooring system.

14 Claims, 9 Drawing Sheets

MOORING SYSTEM FOR A VESSEL

FIELD OF THE INVENTION

The present invention relates to a mooring system for a vessel.

BACKGROUND OF THE INVENTION

Recently, in order to improve the efficiency of marine transportation using containers, large vessels have been used in order to improve the cost effectiveness by increasing the cargo amount. In this connection, there is demand for the development of a new system which is capable of loading and unloading cargo on the sea remote from the land, without berthing such large vessels at a quay wall of a harbor which is provided on the land. Thus, research into a mobile harbor allowing a large ship to anchor in the sea away from the land and to handle cargos, rather than making a large ship to come alongside the pier in the harbor, has been under way.

FIGS. 1A and 1B are schematic diagrams illustrating the mobile harbor in accordance with the related research. The mobile harbor 100 which is a floating body may perform a loading and unloading operation by using a crane 20. FIG. 1A illustrates a loading and unloading operation between the mobile harbor 10 and a large container carrier 30, and FIG. 1B illustrates a loading and unloading operation between the mobile harbor 10 and a quay wall 40.

When a mobile harbor is used to load and unload cargos while a large container carrier is anchored in the sea remote from the land, containers loaded and/or to be loaded on the large container carrier need to be distributed to several small, mobile harbors and transported between the large container carrier and a harbor provided on the land. In this case, the number of berthing operations of the mobile harbors inevitably increases.

In general, a vessel includes a windlass for winding an anchor cable or a mooring winch for winding a mooring rope, in order to moor the vessel in a harbor, and the harbor includes a mooring facility for fixing the mooring rope of the vessel. The conventional vessel or harbor is operated by a manual system depending on human power. Such a manual system has a problem in safety accidents and operation efficiency.

Therefore, there is a need for the development of a new system for quickly and stably mooring or docking a vessel such as a mobile harbor or container carrier.

SUMMARY OF THE INVENTION

The present invention provides a mooring system for a vessel capable of minimizing the time and effort required for a mooring operation on vessels, and maintaining a stable mooring state such that cargos can be smoothly loaded and unloaded.

In accordance with an aspect of the present invention, there is provided a mooring system for a vessel, including: an attachment unit configured to be detachably attached to a hull of the vessel; a robot arm including a plurality of arms, the arms being coupled to each other to turn in a vertical direction, the robot arm extending by an arm actuator provided thereto to transfer the attachment unit to an attachment position the hull; a rotation unit connected to the robot arm and allowing the robot arm to turn in a horizontal direction; and a mooring winch for winding a mooring cable to draw the attachment unit.

In accordance with another aspect of the present invention, there is provided a floating body including the mooring system.

In accordance with still another aspect of the present invention, there is provided a quay wall including the mooring system

BRIEF DESCRIPTION OF THE DRAWINGS

The objects and features of the present invention will become apparent from the following description of embodiments given in conjunction with the accompanying drawings, in which.

DETAILED DESCRIPTION OF THE EMBODIMENTS

Figure 1A:
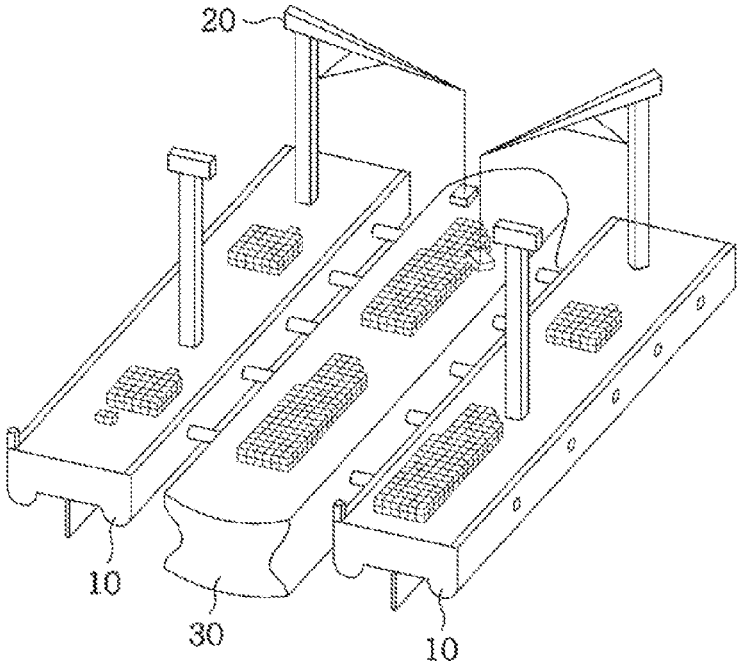
FIG. 1A (PRIOR ART)
FIG. 1A is a schematic diagram illustrating a loading and unloading operation of a mobile harbor on the sea.
Figure 1B:
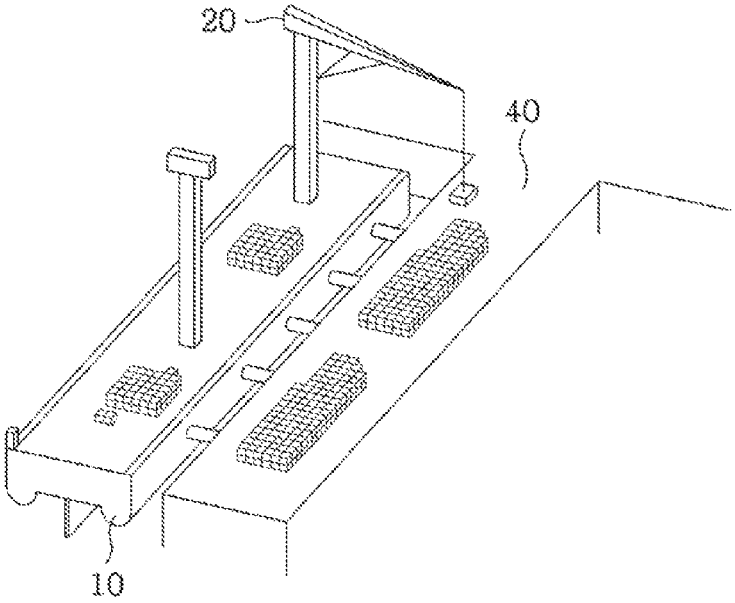
FIG. 1B (PRIOR ART)
FIG. 1B is a schematic diagram illustrating a loading and unloading operation of the mobile harbor on the land.

Hereinafter, embodiments of the present invention will be described in detail with reference to the accompanying drawings. Same reference numeral is given to the same or corresponding element, and a duplicated explanation thereon will be omitted.

Figure 2A:
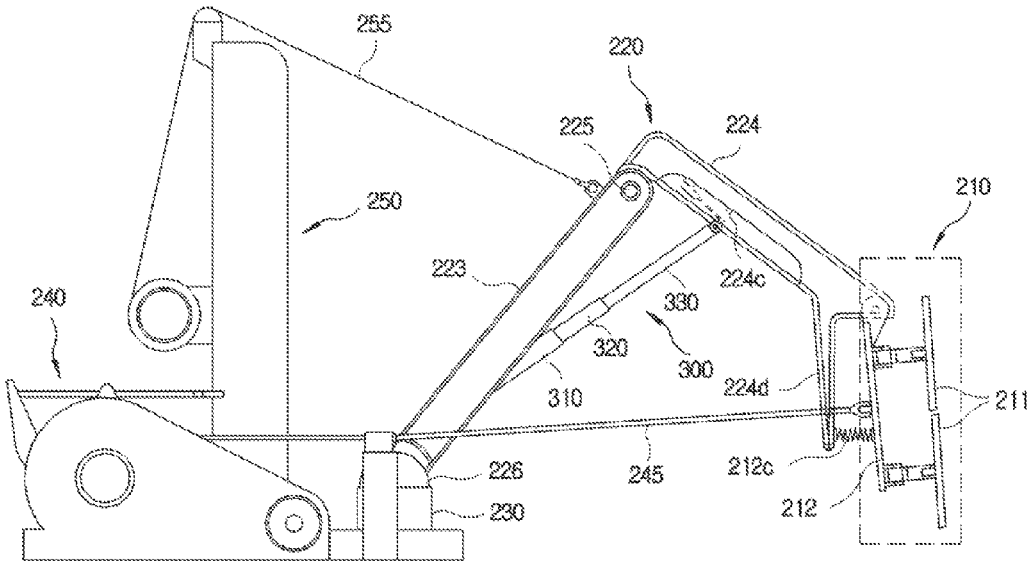
FIG. 2A is a schematic view of a mooring system for a vessel in accordance with an embodiment of the present invention, while the mooring system is mooring a vessel.
Figure 2B:
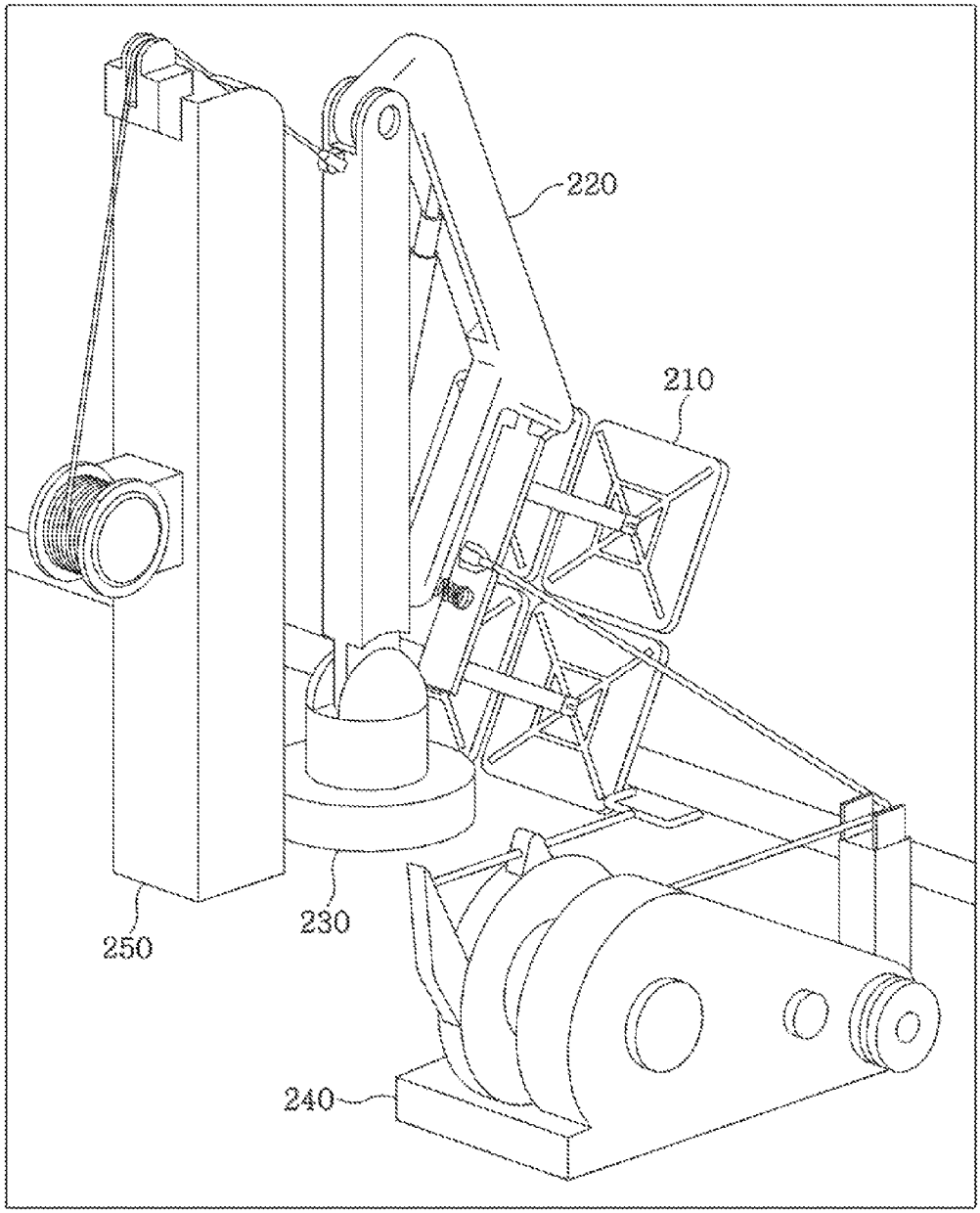
FIG. 2B is a schematic view of the mooring system for a vessel in accordance with the embodiment of the present invention, while a floating body including the mooring system sails.

FIGS. 2A and 2B are schematic views of a mooring system for a vessel in accordance with an embodiment of the present invention. FIG. 2A is a side view of the mooring system while the mooring system is mooring a vessel, and FIG. 2B is a perspective view of the mooring system while a floating body (or a floating structure) including the mooring system sails.

The mooring system 200 includes an attachment unit 210, a robot arm 220, a rotation unit 230, a mooring winch 240, and a robot arm winch 250.

The robot arm 220 includes a plurality of arms which are coupled with hinges to turn in a vertical direction. The robot arm 220 may be extended through extension of an arm actuator to transfer the attachment unit 210 to an attachment position of a hull.

Specifically, the robot arm 220 may include a first arm 223 having an end coupled to the rotation unit 230 provided on an installation surface and a second arm 224 having an end coupled to the other end of the first arm 223 with a hinge 225. The first arm 223 is coupled to the rotation unit 230 with a hinge 226 to turn in the vertical direction.

The arm actuator may have a hydraulic cylinder 300. The cylinder 300 is connected between the first and second arms 223 and 224 and extends to transfer the attachment unit 210. The hydraulic cylinder 300 and the second arm 224 are connected through a spring 224*c* to absorb an impact applied to the second arm 224.

The robot arm 220 has a protrusion portion 224*d* which protrudes to be positioned behind the connection member 212 of the attachment unit 210, and the connection member 212 is connected to the protrusion portion 224*d* through a spring 212*c* to absorb an impact applied to the attachment unit 210.

The robot arm 220 of the mooring system is not limited to the 2-arm link structure illustrated in FIGS. 2A and 2B, but may be constructed to have a variety of link structures. For example, the robot arm 220 may include one or more additional arms, or may have a 4-arm link structure in which a pair of 2-arm links is formed between the rotation unit 230 to the attachment unit 210.

Figure 3A:
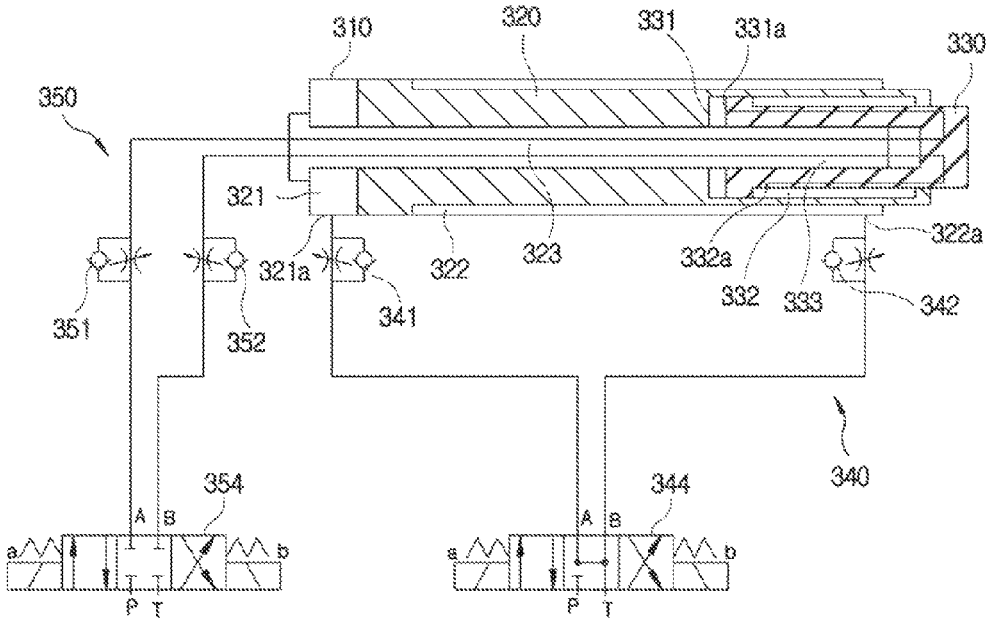
FIG. 3A is a conceptual diagram illustrating a multi-stage hydraulic cylinder and hydraulic circuits in accordance with the embodiment of the present invention.
Figure 3B:
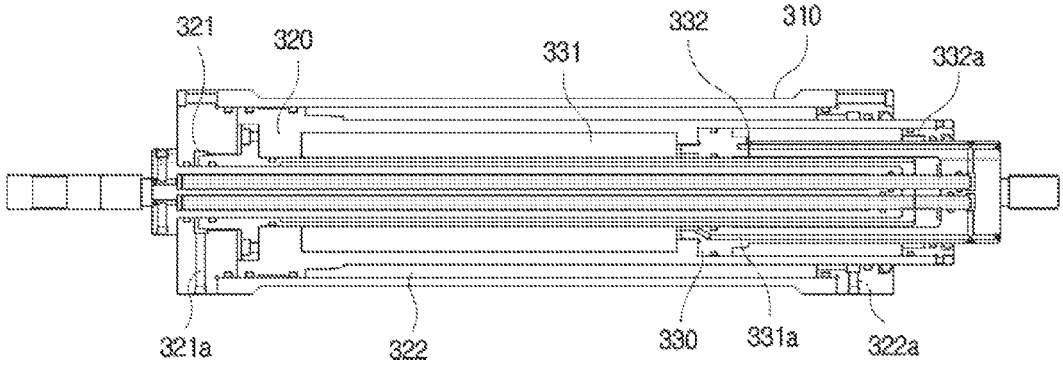
FIG. 3B is a cross-sectional view of the multi-stage hydraulic cylinder in accordance with the embodiment of the present invention.

FIG. 3A is a conceptual diagram illustrating a multi-stage hydraulic cylinder and hydraulic circuits in accordance with the embodiment of the present invention, and FIG. 3B is a cross-sectional view of the multi-stage hydraulic cylinder.

The hydraulic cylinder 300 in accordance with the embodiment of the present invention may include a multi-stage hydraulic cylinder which independently controls the stroke of two or more piston to perform extension and contraction for positioning of the attachment unit 210 and absorption of an impact applied to the attachment unit 210. One piston rod may freely move to provide room for the vessel which rolls or pitches on the sea, and absorb an impact applied by a vessel, in a state that the hydraulic cylinder 300 is in neutral. On the other hand, another piston rod may stop in a state that the multi-stage hydraulic cylinder 300 is in neutral.

The multi-stage hydraulic cylinder 300 includes a cylinder housing 310 having a space formed therein and an opened upper surface and the first and the second-stage piston rod 320 and 330. The first-stage piston rod 320 is inserted into an upper surface (right side in FIG. 3A) of the cylinder housing 310, divides an internal space of the cylinder housing 310 to form a first and a second chamber 321 and 322 to thereby have, and has a space formed therein and an opened upper surface. The second-stage piston rod 330 is inserted into the upper surface of the first-stage piston rod 320 and divides an internal space of the first-stage piston rod 320 to form a third and a fourth chamber 331 and 332.

The first to fourth chambers 321, 322, 331, and 332 may include first to fourth openings 321*a*, 322*a*, 331*a*, and 332*a*, respectively, which are sealed and with which a fluid communicates to apply an oil pressure. The first-stage and second-stage piston rods 320 and 330 have respective hollow holes 323 and 333 formed therein, and a fluid may communicate with the third and fourth chambers 331 and 332 through flow paths formed in the respective hollow holes. The cylinder housing 310 has an opened lower surface (left side in FIG. 3A), and a fluid may communicate with the third and fourth openings 331*a* and 332*a* through the lower surface of the cylinder housing 310.

An oil pressure applied to the pair of the first and second chambers 321 and 322 and an oil pressure applied to the pair of the third and fourth chambers 331 and 332 may be controlled by a first-stage hydraulic circuit 340 and a second-stage hydraulic circuit 350, respectively, which are independently provided. When an oil pressure is applied to the first or the second chamber 321 or 322, the first-stage piston rod 320 is moved vertically (in the horizontal direction in FIG. 3A), and the length of the hydraulic cylinder 300 is extended or contracted. When an oil pressure is applied to the third or the fourth chamber 331 or 332, the second-stage piston rod 330 is moved vertically, and the length of the hydraulic cylinder 300 is extended or contracted. The first-stage hydraulic circuit 340 and the second-stage hydraulic circuit 350 may include check valves 341, 342, 351, and 352 through which a fluid communicates with the first to fourth openings 321*a*, 322*a*, 331*a*, and 332*a*, respectively, to apply an oil pressure.

Chambers in any one pair of the pair of the first and second chambers 321 and 322 and the pair of the third and fourth chambers 331 and 332 may communicate with each other when the hydraulic cylinder 300 is in neutral state. On the other hand, the other pair of chambers may be disconnected from an external hydraulic circuit when the hydraulic cylinder 300 is in neutral state. In this embodiment, the pair of the first and second chambers 321 and 322 may communicate with each other such that the first-stage piston rod 320 freely moves in case of neutral state. The pair of the third and fourth chambers 331 and 332 may be disconnected from an external hydraulic circuit to stop the second-stage piston rod 330 in case of neutral state.

The first-stage hydraulic circuit 340 can make the first-stage piston rod 320 freely move. For this operation, the first-stage hydraulic circuit 340 may include an ABT-connected four-direction control valve 344. The second-stage hydraulic circuit 350 can stop the second-stage piston rod 330. For this operation, the second-stage hydraulic circuit 350 may include a closed-center four-direction control valve 354.

In this embodiment, the two-stage cylinder has been described, but may be extended to three stages or more. In the multi-stage cylinder in accordance with the embodiment of the present invention, two or more piston rods may be independently controlled to perform the extension of the cylinder length and the impact absorption at the same time. Therefore, the multi-stage cylinder 300 may have two or more functions through a simple construction.

Figure 4:
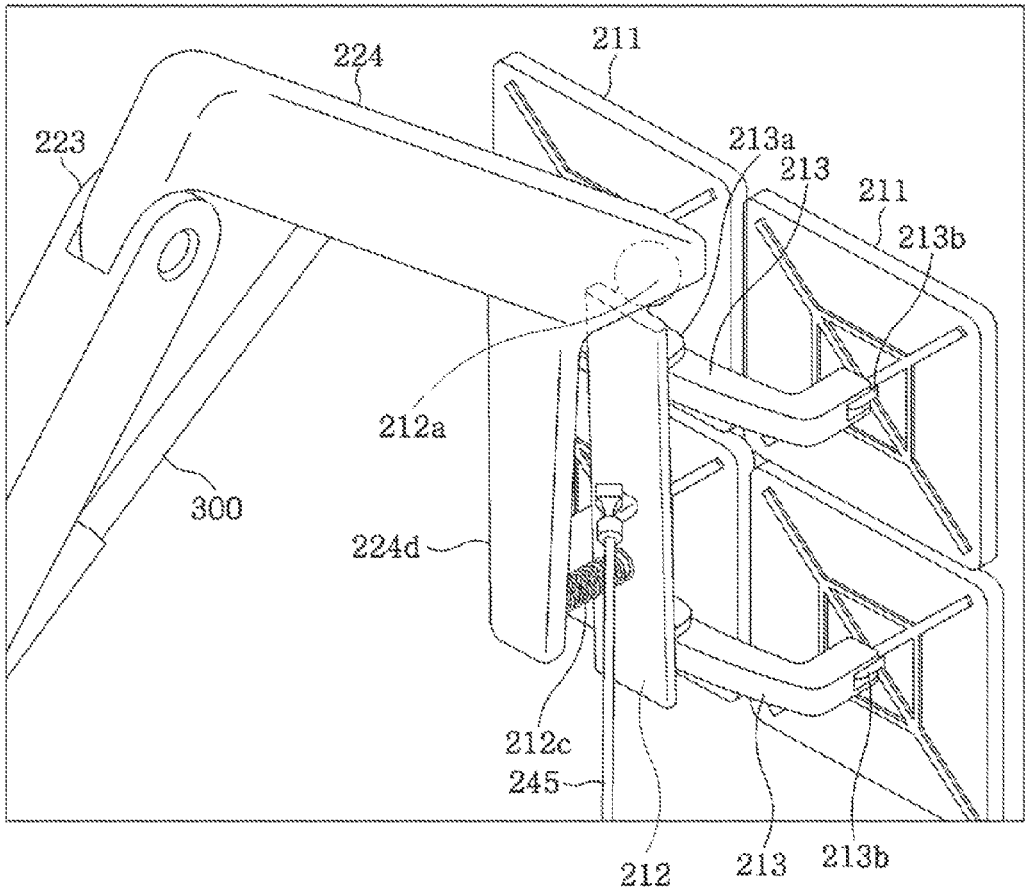
FIG. 4 is a schematic view of an attachment unit in accordance with the embodiment of the present invention.

FIG. 4 is a schematic view of the attachment unit 210 in accordance with the embodiment of the present invention.

The attachment unit 210 is detachably attached to a hull of a vessel to be berthed, such as a container carrier. The attachment unit 210 may include a plurality of suction pads 211 for generating an attachment force by which the attachment unit 210 is attached to the hull. Each of the suction pads 211 may be attached to the hull by vacuum supplied through a vacuum supply line from a vacuum supply unit (not illustrated). For this operation, the suction pad 211 may include a plurality of vacuum holes to which vacuum is supplied. Alternatively, the suction pad 211 may include an electromagnet which is attached to the hull by a magnetic force caused by power supply.

The attachment unit 210 may include a connection member 212 for connecting the suction pad 211 to an end of the robot arm 220. The robot arm 220 and the connection member 212 may be coupled by a ball joint 212*a* so as to rotate about each other.

The suction pads 211 may be coupled to auxiliary connection members 213 by hinges 213*b*, respectively. In this case, the suction pads 211 may be arranged in line or in a two-dimensional manner with respect to the connection member 212. Each of the auxiliary connection members 213 has an end coupled to the connection member 212 by the ball joint

213*a*. The suction pads 211 may be moved with a multi degree of freedom by the ball joints 212*a* and 213*a* and the hinges 213*b*. Therefore, the suction pads 211 may change the posture in correspondence to various shapes of hulls. Alternatively, the ball joints and hinges 212*a*, 213*a* and 213*b* may be substituted with joints of different type.

Figure 5:
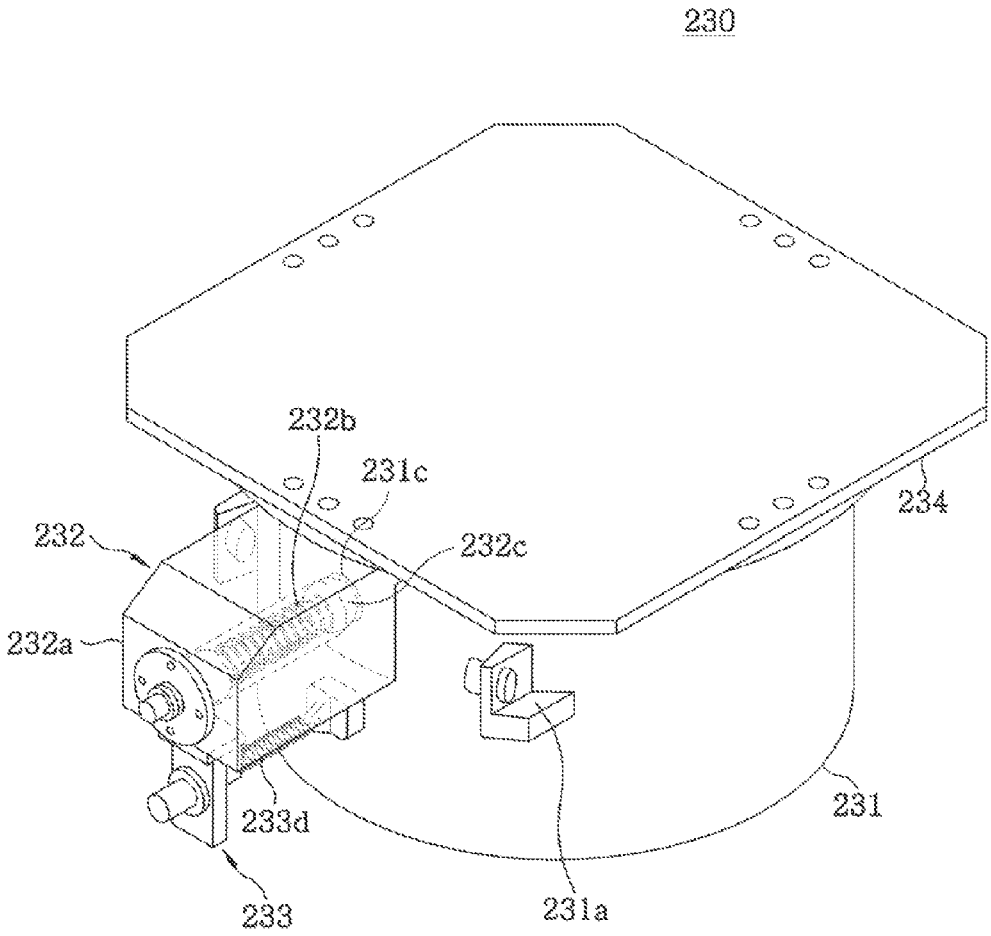
FIG. 5 is a schematic view of a rotation unit in accordance with the embodiment of the present invention.

FIG. 5 is a schematic view of the rotation unit 230 in accordance with the embodiment of the present invention.

The rotation unit 230 is connected to the robot arm 220 to rotate the robot arm 220 in a horizontal direction (e.g., in a left and right direction) within a predetermined angle range based on the axis perpendicular to the installation surface. When the floating body having the mooring system 200 installed therein moves in the longitudinal, direction thereof, a rotational force is applied.

The rotation unit 230 includes a rotation member 234, a rotation adjustment part 232, a fixed shaft 231, and a restoration part 233. The rotation member 234 is connected to the robot arm 220 to rotate in the horizontal direction together with the robot arm 220. The rotation adjustment part 232 allows the rotation member 234 to rotate from an initial position, when a predetermined load or a load more than that is applied. The fixed shaft 231 includes stopper for limiting the rotation member 234 within a predetermined angle range, for example, 15 degrees and is fixed to the installation surface. The restoration part 233 restores the rotated rotation member 234 to the initial position.

The rotation adjustment part 232 includes a case 232*a* coupled to be fixed to the rotation member 234, and the case 232*a* is rotated together with the rotation member 234. The rotation of the case 232*a* is limited by the stopper 231*a*. A ball 232*c* is provided inside the case 232*a*, and has portion inserted into a hole 231*c* formed in the fixed shaft 231. When a rotational force of a predetermined load or more is applied, the ball 232*c* may be moved out of the hall 231*c*. A spring 232*b* applies a compressive force to the ball 232*c* such that the compressive force is directed toward the hole 231*c*. When a load less than the predetermined load is applied, the spring 232*b* stops the ball 232*c*.

The restoration part 233 includes a spring 233*d* having both ends coupled to the rotation adjustment part 232 and the fixed shaft 231, respectively. When the rotation member 234 is rotated, the spring 233*d* is lengthened to restore the rotation member 234.

Referring to FIGS. 2A and 2B, the mooring winch 240 winds the mooring cable 245 to draw the hull attached to the attachment unit 210 toward the installation surface. The mooring winch 240 serves to suppress the vessel from moving away from the mooring system 200 when the attachment unit 210 is attached to the hull. Although not illustrated, the mooring winch 240 includes a variety of sensors and actuators which control a mooring force to be automatically and constantly maintained. The mooring operation may be stably and automatically performed in correspondence to a drift, winds, waves, tides, and the like.

When the attachment unit 210 is attached to the hull, the driving power of the robot arm 220 may be turned off. Then, the mooring winch 240 may cover all or most of the load generated by the mooring of the vessel such that the load, is not applied to the robot arm 220. The mooring winch 240 may free the robot arm 220 from the load. The hydraulic cylinder 300 may be freely extended and contracted when the mooring winch serves to suppress the vessel. Therefore the physical fatigue of the robot arm 220 may be prevented, and the structure may be simplified.

The mooring cable 245 has an end connected to the attachment unit 210 to draw the attachment unit 210. For example, the mooring cable 245 may be directly connected so the connection member 212 or connected through a separate member. Alternatively, the mooring cable 245 may be connected to an end of the robot arm 220.

The robot arm winch 250 may wind the robot arm cable 255 to draw the robot arm 220. Similar to the mooring winch 240, the robot arm winch 250 may cover a load generated when the attachment unit 210 is attached to the hull, thereby preventing the physical fatigue of the structure.

Meanwhile, although not illustrated, the mooring system 200 in accordance with the embodiment of the present invention may include a variety of actuators for driving the winch, the hinges, the ball joints, and the cylinder.

In the mooring system 200, a position and posture of the attachment unit 210 may be adjusted in correspondence to a size or a shape of a vessel to be berthed, thereby making it possible to berth the vessel efficiently. Furthermore, the docking impact is absorbed by the multi-stage cylinder 300 and the elasticity of the springs 224*c* and 212*c*, and the distance between vessels is constantly maintained to stably berth or anchor the vessels. Furthermore, the mooring system 200 may minimize the use of human power such that the mooring operation automatically performed, thereby reducing the danger of safety accident and increasing the efficiency.

Figure 6A:
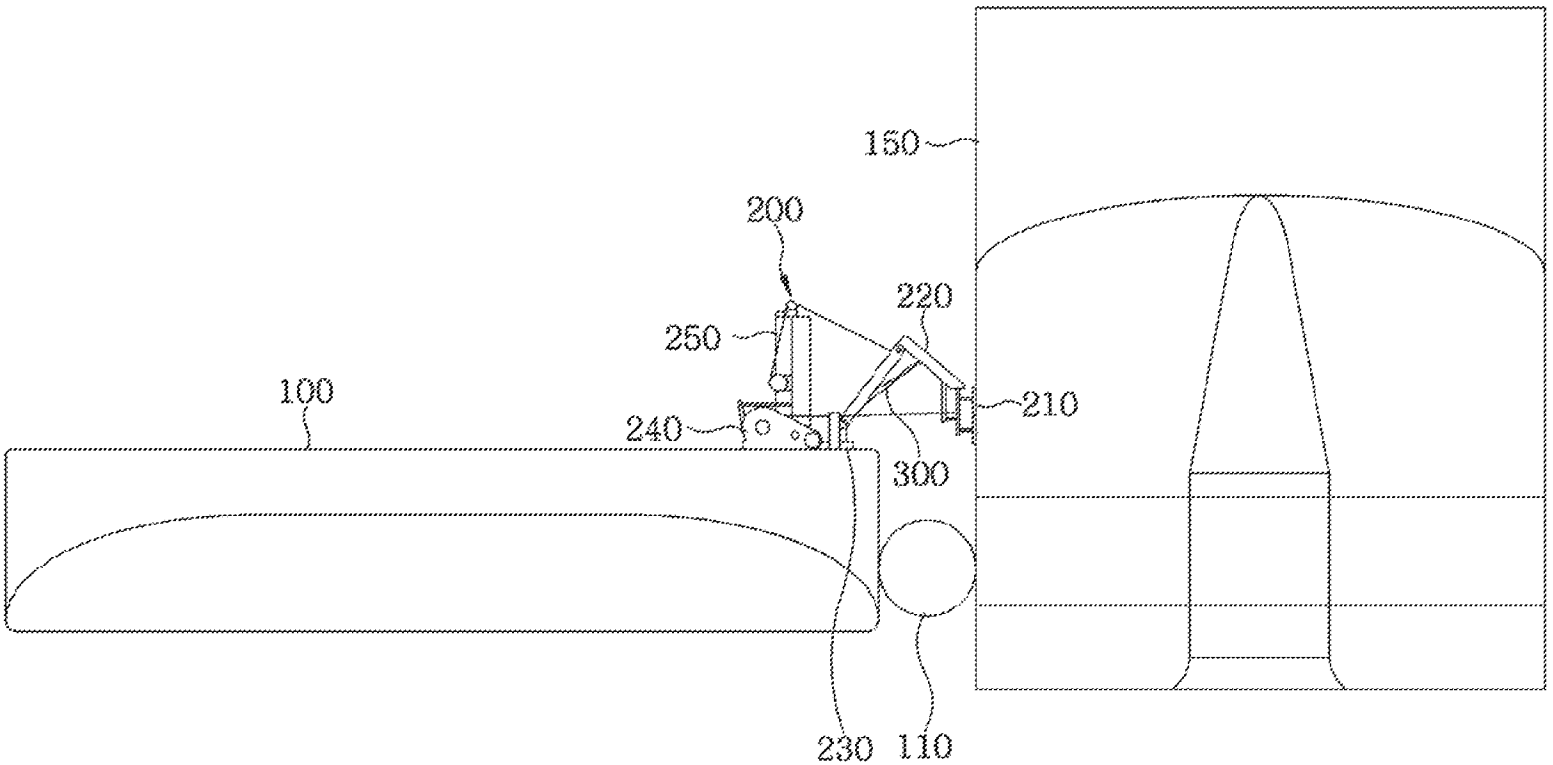
FIG. 6A is a front view conceptual diagrams illustrating a state in which a mobile harbor having the mooring system mounted thereon is berthing at a container carrier.
Figure 6B:
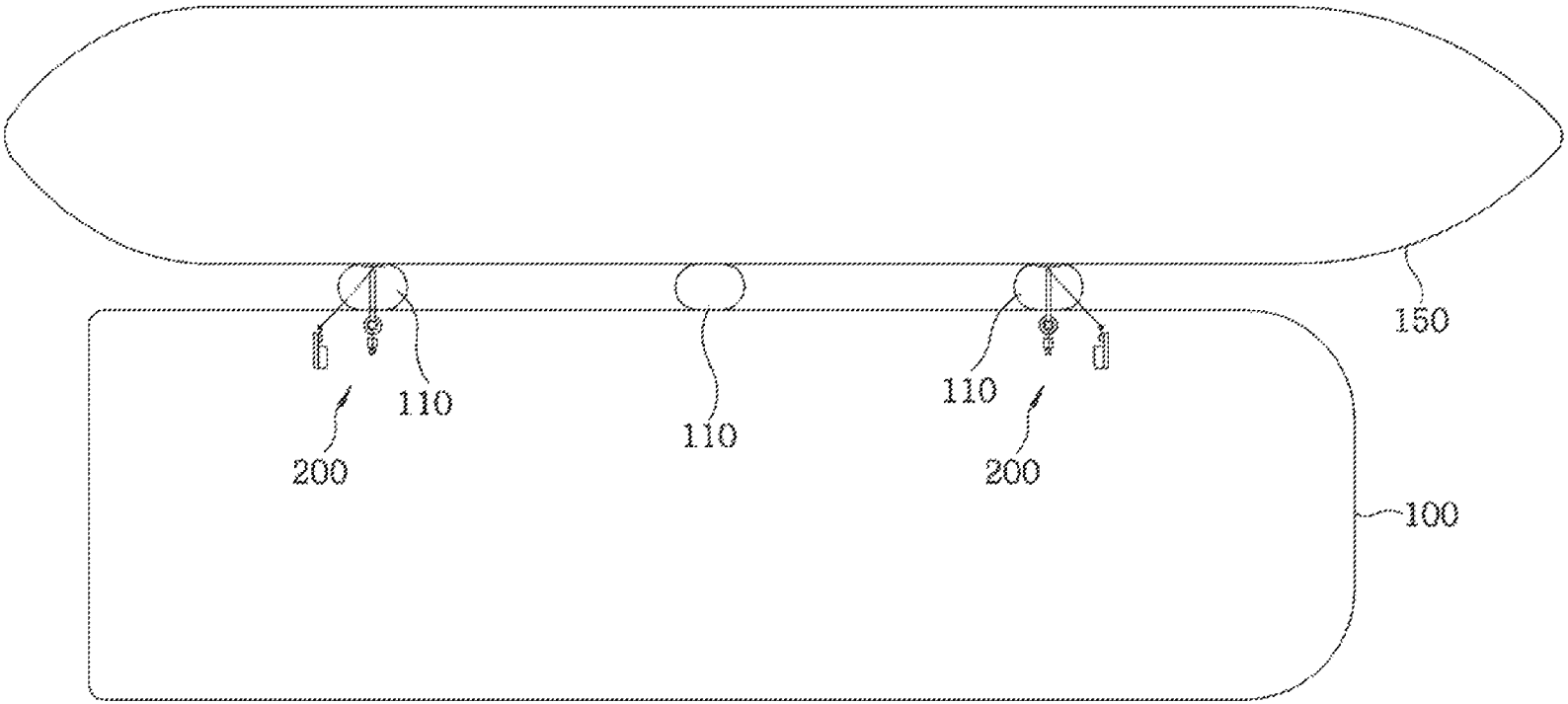
FIG. 6B is a plan view of the conceptual diagrams of FIG. 6A.

FIGS. 6A and 6B are conceptual diagrams illustrating a state in which a mobile harbor having the mooring system mounted thereon is berthing at a container carrier. FIG. 6A is a front view, and FIG. 6B is a plan view.

A plurality of the mooring systems 200 may be disposed on a side surface of a floating body such as a mobile harbor. The mobile harbor 100 may include a vessel which may move by using its own power or a floating body moored on the sea. The mobile harbor 100 may transfer containers between the container carrier 150 and a harbor on the land, and temporarily load containers in place of the harbor on the land, while floating on the sea.

The mobile harbor 100 may include a platform having a space in which a container is loaded, a loading device (e.g. a crane) for handling a container, a location determining device for acquiring information regarding the location of the platform, and a balancing device for adjusting the platform such that the platform can be maintained in a vertical location correspondingly to a change in she weight based on the loading and unloading of the container.

The mobile harbor 100 in accordance with the embodiment of the present invention may further include a fender 110 installed between the mobile harbor 100 and the hull of a vessel, such as the container carrier 150. Therefore, when the mooring cable 245 is wound, the fender 110 prevents the hull from colliding with the mobile harbor 100, and simultaneously pushes the hull to maintain the tension of the mooring cable 245. Therefore, even when the sea condition is not stable, for example, even when the waves are high, the mooring operation for the vessel can be performed stably.

The fender 110 may be installed on the mobile harbor 100, the hull of the container carrier 150, or another structure. The fender 110 may have a variety of installation structures. For example, the fender 110 may be installed to float on the surface of the sea or fixed to be positioned at a predetermined level. The fender 110 may be formed of a structure capable of enduring a strong external force and frictional force, while absorbing an impact.

Figure 7:
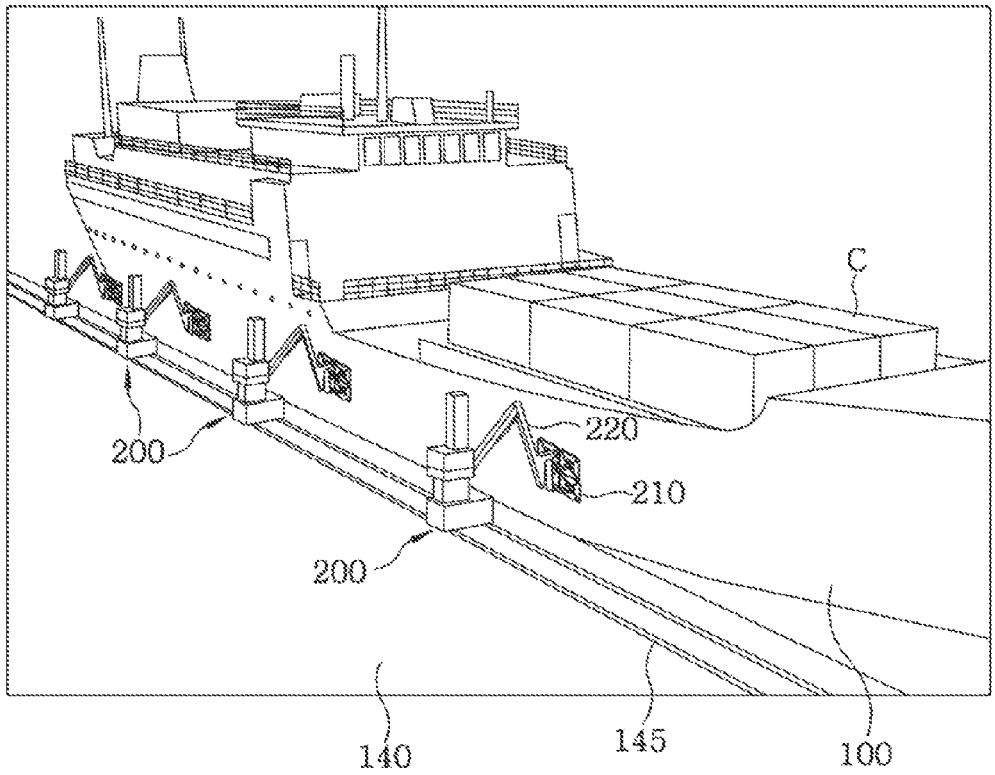
FIG. 7 is a conceptual diagram illustrating a state in which a mobile harbor is berthing at a quay wall in which the mooring system in accordance with the embodiment of the present invention is disposed.

FIG. 7 is a conceptual diagram illustrating a state in which a mobile harbor is berthing at a quay wall in which the mooring system in accordance with the embodiment of the present invention is disposed.

The mooring system 200 may be disposed at a quay wall 140 or a quay on the land and used when a vessel is berthed or moored at the quay wall on the land. The mooring system 200 may moor the mobile harbor 100 at a proper position while moving along a rail 145 formed on the quay wall 140. In addition, another vessel such as a container carrier or a floating body may be moored at the quay wall 140 where the mooring system in accordance with the embodiment of the present invention is installed.

Hereinafter, referring to FIGS. 6A and 6B, a mooring method in a case in which the mooring system in accordance with the embodiment of the present invention is installed in a mobile harbor will be described.

The mooring method may include a step of transferring the attachment unit 210 to the hull by using the robot arm 220, a step of attaching the attachment unit 210 to the hull, a step of putting the hydraulic cylinder 300 of the robot arm 220 into neutral, and a step of winding the mooring cable 245.

At the step of transferring the attachment 210 to the hull by using the robot arm 200, the mobile harbor 100 is approximated to the container carrier 150 to be berthed, and an optimal attachment position is selected. The attachment unit 210 may be transferred to the position, by the movement of the robot arm 220 and the posture change of the attachment unit 210. At this time, the movement of the robot arm 220 may be performed by the extension of the hydraulic cylinder 300 and the suction pads 211 are rotated by the ball joints 212*a* and 213*a* and hinges 213*b*.

At the step of attaching the attachment unit 210 to the hull, the attachment unit 210 may be attached to the hull by the supply of vacuum or a magnetic force.

At the step of winding the mooring cable 215, the mooring cable 245 is wound by the mooring winch 240 to draw the attachment unit 210, in order to cover a load caused by docking or mooring the vessel. At this time, the hydraulic cylinder 300 of the robot arm 220 is put into neutral. And further the power (or actuators) of the hinges 213*b* or the ball joints 212*a* and 213*a* may be turned off, in order to free the robot arm 220 from the load.

Before the mooring cable 245 is wound, the fender 110 may be installed between the mobile harbor 100 having the robot arm 220 installed thereon and the hull of the container carrier 150.

In accordance with the embodiment of the present invention, the mooring system may minimize the time and effort required for a mooring operation, and may maintain a stable mooring state therebetween such that cargo is smoothly loaded and unloaded.

The mobile harbor in accordance with the embodiment of the present invention performs a loading and unloading operation for a large container carrier on the sea. Therefore, the cargo transportation of a large container carrier, which needs to be performed in deep water, may be efficiently processed, whereby it will contribute to strengthening the harbor system competitiveness.

While the invention has been shown and described with respect to the preferred embodiments, it will be understood by those skilled in the art that various changes and modifications may be made without departing from the scope of the invention as defined in the following claims.

What is claimed is:

1. A mooring system for a vessel, comprising:

an attachment unit configured to be detachably attached to a hull of the vessel;

a robot arm including a plurality of arms, the arms being coupled to each other to turn in a vertical direction, the robot arm extending by an arm actuator provided thereto to transfer the attachment unit to an attachment position of the hull;

a rotation unit connected to the robot arm and allowing the robot arm to turn in a horizontal direction; and a mooring winch for winding a mooring cable to draw the attachment unit, wherein the attachment unit includes a plurality of suction pads configured to generate a suction force by which the attachment unit is attached to the hull, and wherein the rotation unit includes:

a rotation member connected to the robot arm to rotate in the horizontal direction together with the robot arm, and a rotation thereof being limited within an angle range;

a rotation adjustment part allowing the rotation member to rotate from an initial position when a predetermined load or greater is a applied thereto; and a restoration part for restoring the rotation member rotated by the rotation member to the initial position.

2. The mooring system of claim 1, wherein the robot arm includes a first arm coupled to the rotation unit and a second arm coupled to the first arm and the attachment unit; and the arm actuator has a hydraulic cylinder connected to the first arm and the second arm and serving to absorb an impact applied to the second arm.

3. The mooring system of claim 2, wherein the hydraulic cylinder is connected to the second arm through a spring to absorb the impact applied to the second arm.

4. The mooring system of claim 2, wherein the second arm has a protrusion portion disposed behind the attachment unit; and the attachment unit is connected to the protrusion portion through a spring to absorb an impact applied to the attachment unit.

5. The mooring system of claim 1, wherein the attachment unit includes a connection member for connecting the suction pads to the robot arm; and the robot arm and the connection member are coupled to each other by a ball joint.

6. The mooring system of claim 5, wherein the suction pads are arranged in a two-dimensional manner; and each of the suction pads is coupled to the connection member through a ball joint.

7. The mooring system of claim 1, wherein the rotation adjustment part has:

a case which is rotated together with the rotation member;

a ball provided in the case and having a portion inserted into a fixed hole, the ball being moved out of the hole when the predetermined load or greater is applied; and a spring provided in the case and applying a compressive force to the ball toward the hole.

8. The mooring system of claim 1, wherein the mooring winch serves to suppress the vessel from moving away from the mooring system when the attachment unit is attached to the hull.

9. The mooring system of claim 1, further comprising a robot arm winch for winding a robot arm cable to draw the robot arm.

10. The mooring system of claim 1, wherein the robot arm includes a first arm coupled to the rotation unit and a second arm coupled to the first arm and the attachment unit;

the arm actuator has a hydraulic cylinder connected to the first arm and the second arm and serving to absorb an impact applied to the second arm, the attachment unit includes a plurality of suction pads for generating an suction force by which the attachment unit is attached to the hull;

the mooring winch serves to suppress the vessel from moving away from the mooring system when the attachment unit is attached to the hull.

11. A floating body comprising the mooring system of claim 1.

12. The floating body of claim 11, further comprising a fender provided between a side surface thereof and the hull.

13. A quay wall comprising the mooring system of claim 1.

14. The quay wall of claim 13, further comprising a rail allowing the mooring system to move thereon.

* * * * *